United States Patent [19]

Malzahn

[11] Patent Number: 4,683,691

[45] Date of Patent: Aug. 4, 1987

[54] PROTECTIVE ANNULAR CONSTRUCTION AND METHOD OF MANUFACTURE

[76] Inventor: Paul Malzahn, 1328 Jay St., New Orleans, La. 70122

[21] Appl. No.: 832,372

[22] Filed: Feb. 24, 1986

[51] Int. Cl.[4] ..... E04H 9/04; E04H 9/12

[52] U.S. Cl. ..... 52/167; 52/169.6; 52/245; 52/742; 109/1 S; 405/133

[58] Field of Search ..... 52/169.6, 742, 245, 52/167, 21, 742; 109/1 S; 89/1.8, 1.816, 36.01, 36.04; 405/287, 282, 11, 133, 134; 264/31-33

[56] References Cited

U.S. PATENT DOCUMENTS

| | | | |
|---|---|---|---|
| 933,776 | 9/1909 | Moran | 405/133 |
| 941,087 | 11/1909 | Moore | 405/133 |
| 1,380,203 | 5/1921 | Glick | 405/11 |
| 1,615,350 | 1/1927 | Tambone | 52/167 |
| 1,728,736 | 9/1929 | Shergold | 52/167 |
| 1,847,820 | 3/1932 | De Montalk . | |
| 2,166,632 | 7/1939 | Hardesty | 52/21 |
| 2,659,210 | 11/1953 | Stengel | 405/282 |
| 3,077,704 | 2/1963 | Osterberg | 52/742 |
| 3,462,896 | 8/1969 | Lokensgaard | 52/245 |
| 4,151,689 | 5/1979 | Schabert | 52/169.5 |
| 4,508,472 | 4/1985 | Handy | 52/167 |

FOREIGN PATENT DOCUMENTS

| | | |
|---|---|---|
| 626154 | 8/1978 | U.S.S.R. . |
| 747939 | 7/1980 | U.S.S.R. . |

OTHER PUBLICATIONS

Annals of a Fortress by Viollet-Le-Duc, 1876, pp. 98-103.

*Primary Examiner*—John E. Murtagh
*Attorney, Agent, or Firm*—Stevens, Davis, Miller & Mosher

[57] ABSTRACT

A protective annular construction for protecting surface or subsurface facilities against shock. In one embodiment, the invention utilizes concentric slip formed concrete cylinders, at least partially embedded in the soil as a sacrificial construction to dissipate the shock. A method of forming the construction by slip casting concrete shapes followed by, or simultaneously excavating the soil beneath the void between the concrete shapes to allow the cylinders to descend into the soil.

18 Claims, 11 Drawing Figures

PROTECTIVE ANNULAR CONSTRUCTION AND METHOD OF MANUFACTURE

BACKGROUND OF THE INVENTION

1. Field of the Invention

The present invention relates to a protective construction and method of construction to enhance facility, aircraft and missile survivability, from conventional as well as nuclear attacks. The present invention utilizes sacrificial walls comprised of concrete, preferably constructed by using the slip form process, thus providing maximum survivability at minimal cost and requiring the least amount of construction time.

The present invention recognizes the effect that an explosion, blast, heat and shock waves have on facility, aircraft and missile emplacements. The present inventor has developed a construction and method of constructing whereby sacrificial annular single or multiple wall structures are at least partially embedded into the soil surrounding the aircraft, missile, or other facility to be protected.

2. Description of the Prior Art

Concrete constructions of various shape, size and utility are generally well-known in the prior art as evidenced for example in U.S. Pat. No. 3,462,896. The concrete construction described therein is comprised of a series of concrete blocks placed in successive circular rows in end-to-end relationship and one above the other to form an annular construction of a size to protect a workman from cave-ins as he manually digs an excavation in the soil. However, such a construction is not suitable for the protection of facilities such as aircraft or missiles, nor is the method of placement suitable for the protection of such facilities.

Attempts have also been made to provide protection for buildings from shocks such as those associated with an earthquake, as in U.S. Pat. No. 1,615,350. The teachings of the patent envision the excavation of the soil or earth surrounding the building and the construction of a surrounding wall spaced from the building and adjacent the wall of the excavation. An intervening space between said wall and the building provides no resistance whatsoever to lateral movements due to undulatory shocks. That construction and method are also unsatisfactory in that the earth must be excavated prior to the formation of the wall surrounding the building.

Other attempts to provide shock absorbing means for buildings are disclosed in U.S. Pat. No. 1,847,820 which relies on the presence of a material between the sole plate of the building and the platform or foundation laid directly upon the ground or piles. This construction and method would give little or no protection from the effects of explosion or nuclear attack.

Other prior art constructions, such as are shown in Japanese Pat. Nos. 55-9971 and 55-9972, have been conceived. Additional attempts of the prior art can also be found in USSR Pat. Nos. 626,154 and 747,939. However, none of these patents disclose a method of construction and the resulting construction that will provide effective protection against explosion, heat, shock, radiation, or blast and which can be constructed in a rapid and economical fashion.

SUMMARY OF THE INVENTION

A principal object of the present invention is to provide a construction that will increase the survivability of a facility such as a building, barracks, hangar, aircraft, radar unit or other similar facility from the effects of explosion, heat, shock, earthquake, radiation or blast which construction comprises, in a preferred embodiment, an annular concrete construction at least partially embedded in the earth and which at least partially surrounds the facility to be protected.

In one embodiment of the invention, the facility to be protected comprises a missile silo which is protected by the formation of inner and outer annular concrete cylinders of concrete. These cylinders are preferably spaced apart with the surfaces of the cylinders defining a void between them.

In a particularly preferred embodiment, that portion of the void between the two annular concrete cylinders may be filled, above ground level, with a lean mix concrete fill having no coarse aggregate. Below ground level, a void space is maintained between the cylinders.

These and other objects are obtained by the formation of annular reinforced concrete shapes, preferably by slip forming each of the concrete shapes, such as cylinders, beginning at ground level and excavating the earth from between the annular shapes so as to permit the shapes or cylinders to individually cut into and descend into the soil surrounding the facility to be protected.

DETAILED DESCRIPTION OF THE INVENTION

Figure 1:
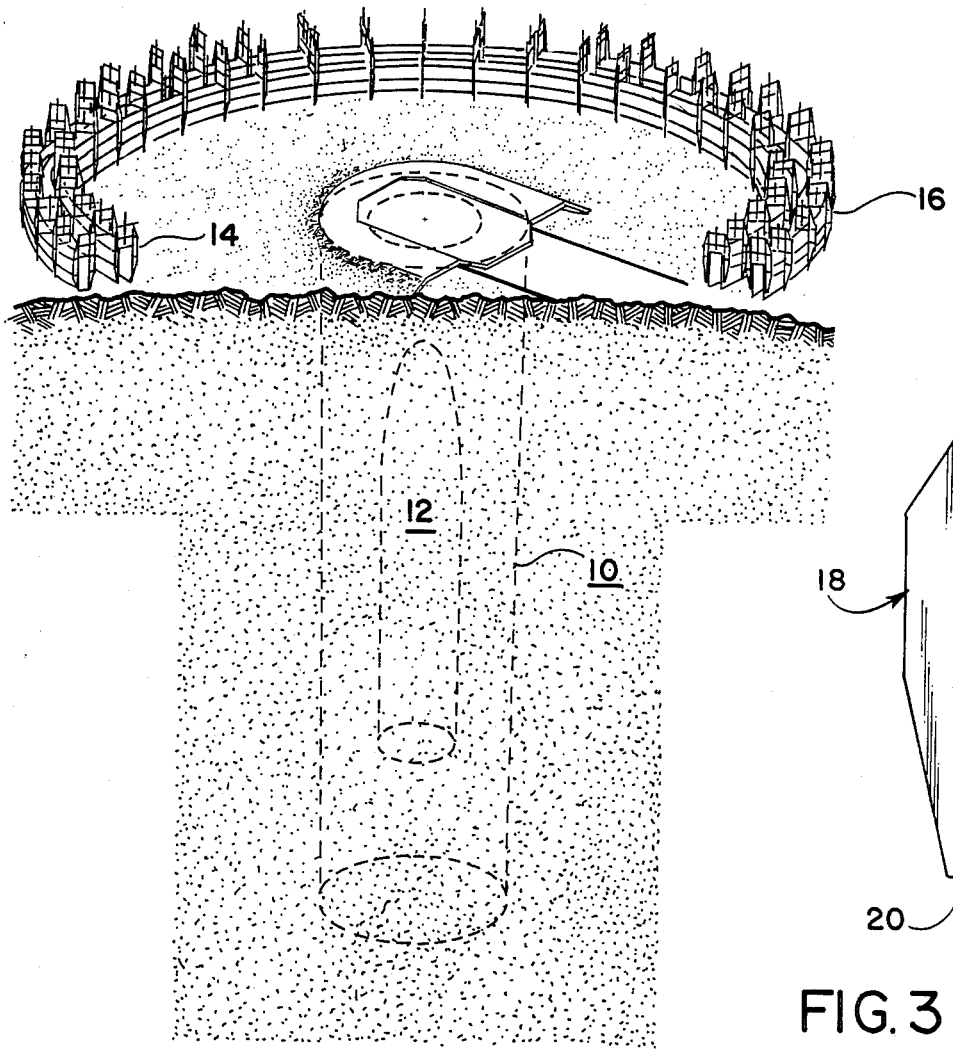
FIG. 1 is a perspective partially cut-away view of the initial placement of a plurality of slip forms about a missile silo to be protected.

FIG. 1 illustrates a conventional missile silo 10 having missile 12 therein. A series of inner slip forms 14 and outer slip forms 16 are placed substantially concentrically about silo 10.

Figure 3:
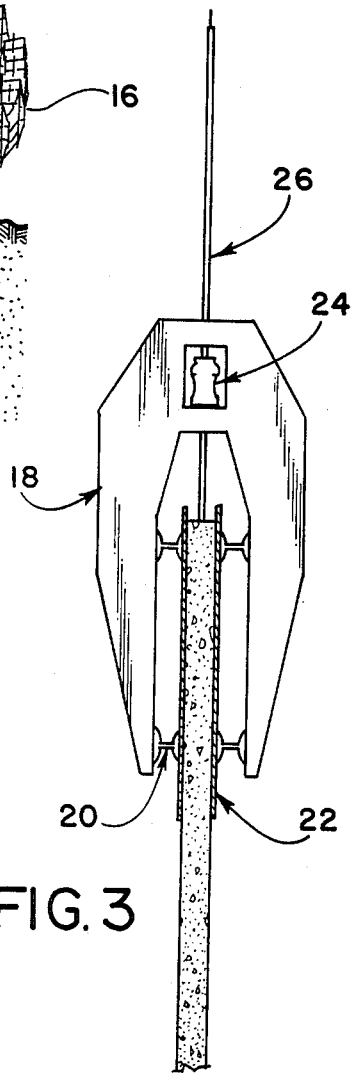
FIG. 3 shows an enlarged view of the slip forming apparatus.

As shown in FIG. 3, each of the slip forms 14 and 16 comprises a yoke 18 which carries waling 20, each supporting a form panel 22. The form panels 22 are preferably of metal. Yoke 18 is lifted in a known manner by hydraulic jack 24 operating against jack rod 26.

Each of the annular shapes may be formed of concrete of suitable thickness, and the present inventor has found thickness of eighteen inches to two feet, or more to be suitable for most applications.

Figure 4:
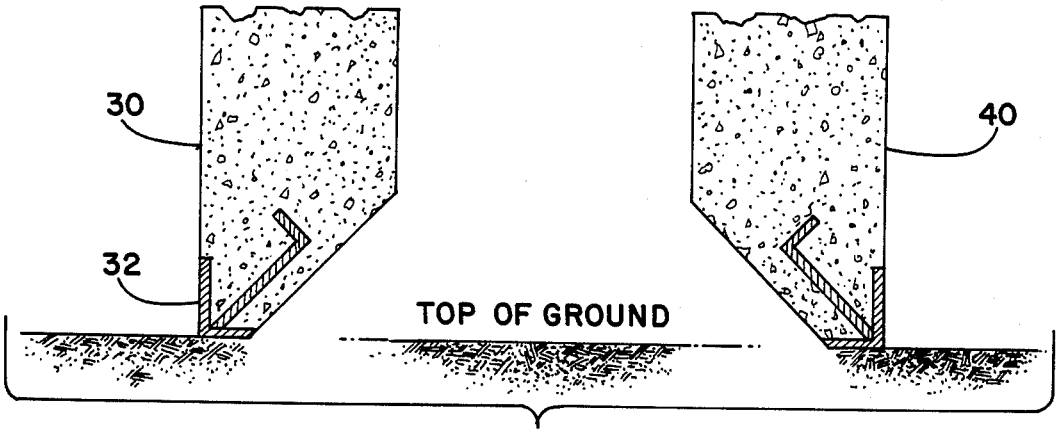
FIG. 4 shows an enlarged view of the foot portion of each of the slip formed annular concrete shapes.
Figure 11:
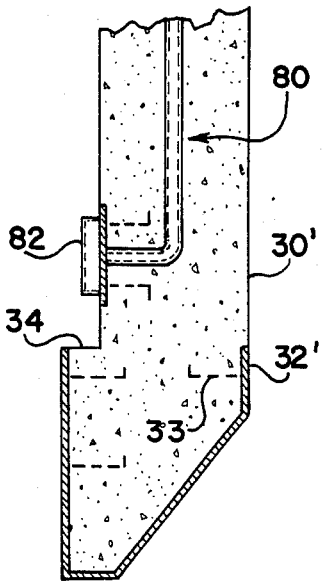
FIG. 11 is an alternative embodiment of the sole or shoe of the annular cylinder having a prefabricated cutting shoe of steel offset for over-cutting the soil as the concrete cylinder descends into the soil.

The foot or sole of each of outer concrete cylinder 30 or inner concrete cylinder 40 is initially formed so as to contain a cutting edge. Cutting edge 32 of outer concrete cylinder 30 is formed of an embedded metal plate formed of one half inch steel forming the base and lower side wall portions of the outer concrete cylinder wall 30. Typically, the dimensions of such a steel member 32, having an L-shaped cross-section are 7 inches in the side wall direction by 4 inches at the base have been found satisfactory. In the alternative embodiment, as shown in FIG. 12, a prefabricated steel shoe 32' having anchors 33 may be embedded into the lower portion of the concrete cylinder 30' so as to enclose the same. In the embodiment of FIG. 11, the cutting edge of steel shoe 32' is offset at 44 for over-cutting the earth as outer concrete cylinder 30' descends thereinto. Of course, the same construction of the cutting shoe of FIG. 4 or FIG. 11 can be provided on the inner concrete cylinder 40.

Figure 2:
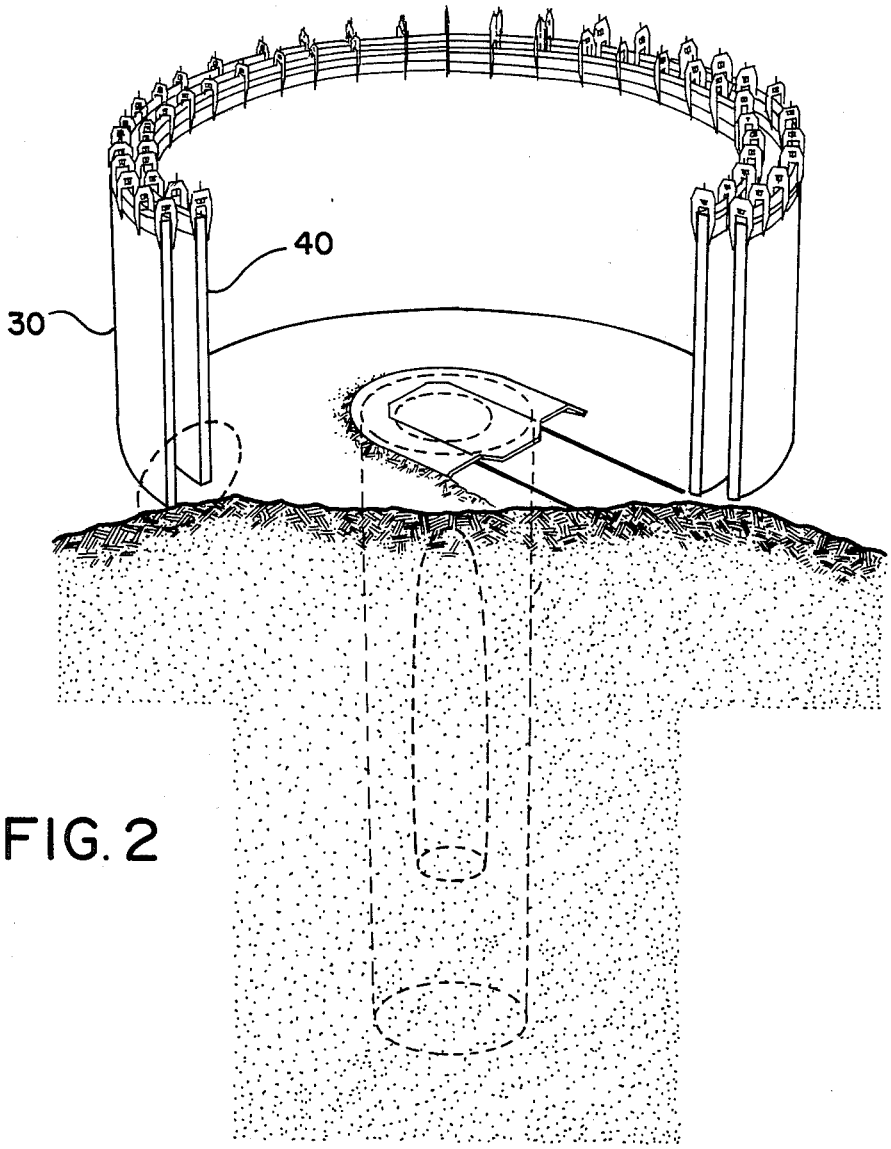
FIG. 2 shows the initial construction of a portion of the slip formed annular concrete shapes.
Figure 6:
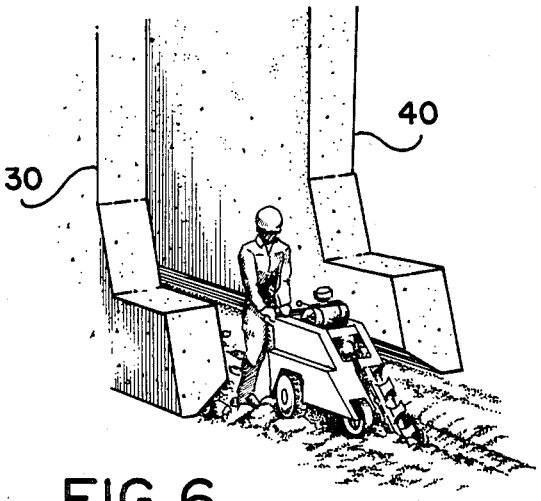
FIGS. 5 and 6 each show removal of soil from between annular concrete shapes.
Figure 5:
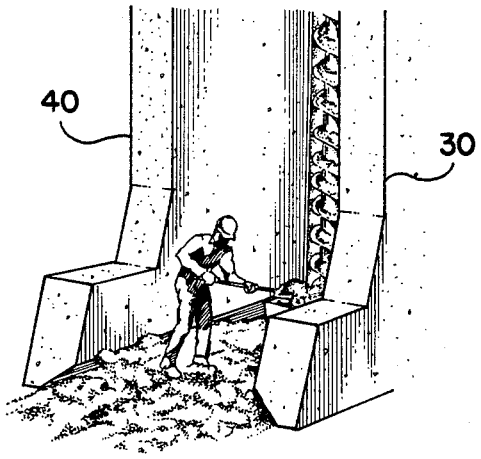
Figure 7:
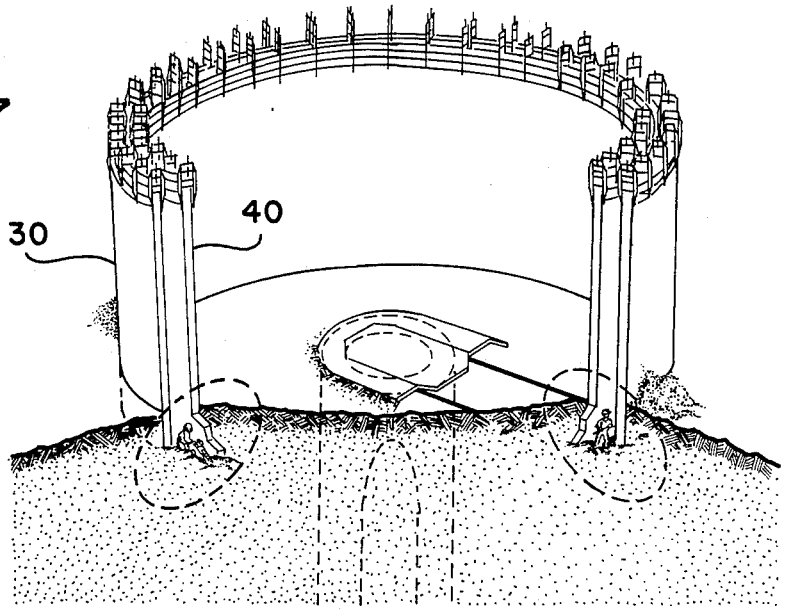
FIG. 7 is a plan view showing the settling of the annular concrete shapes below grade.

As can be appreciated from FIG. 2, as the concrete cylinders 30 and 40 are slip formed to a substantial height, excavation between the same may be effected by workmen or machinery as shown in FIGS. 5 and 6. When the earth is removed from between the cylindrical concrete cylinders 30 and 40, the cutting edges at the foot of each cylinder, forced by the weight of the concrete cylinder, move the earth into the space between concrete cylinders 30 and 40. This permits the workmen to excavate that portion of the earth directly beneath the void between the cylinders while permitting each of the cylindrical concrete structures to settle and descend into the soil. Suitable elevators lift the soil above the height of the cylinders for disposition. Although FIG. 7 illustrates the simultaneous excavation while the concrete cylinders are being slip formed, it is possible to slip form the concrete cylinders to the desired height prior to commencement of excavation. Additionally, it is also possible to alternate the excavation and slip forming operations whenever desired.

Figure 8:
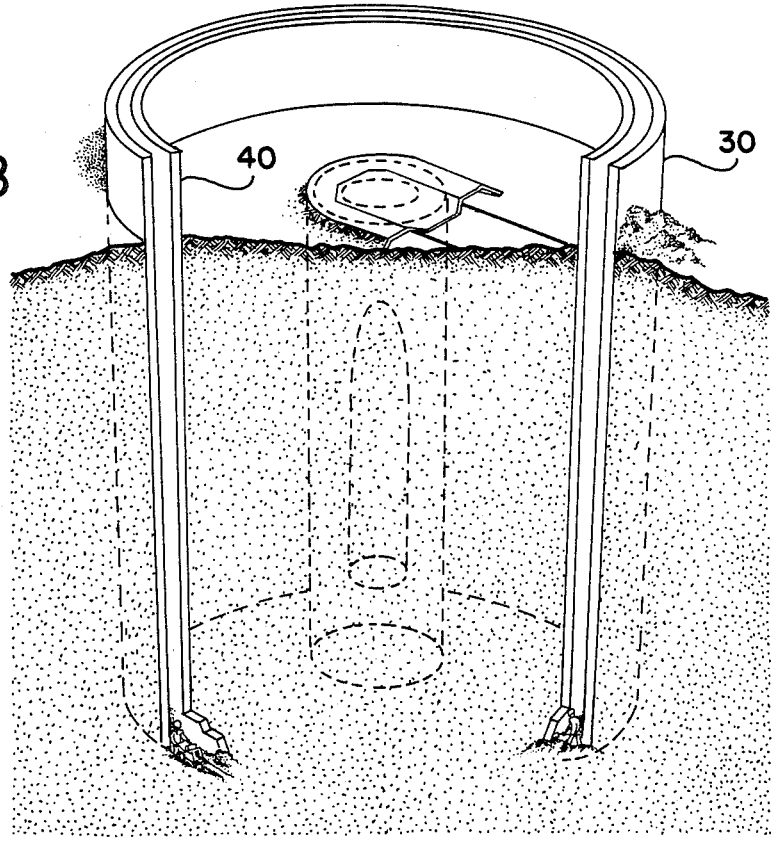
FIG. 8 is a perspective view showing the completed slip formed annular shapes with slip forms removed.

In FIG. 8, it can be appreciated that the slip forming of annular concrete shapes in the form of two cylinders has been completed and the individual slip forms have been removed from the resulting concrete cylinders 30 and 40.

Figure 9:
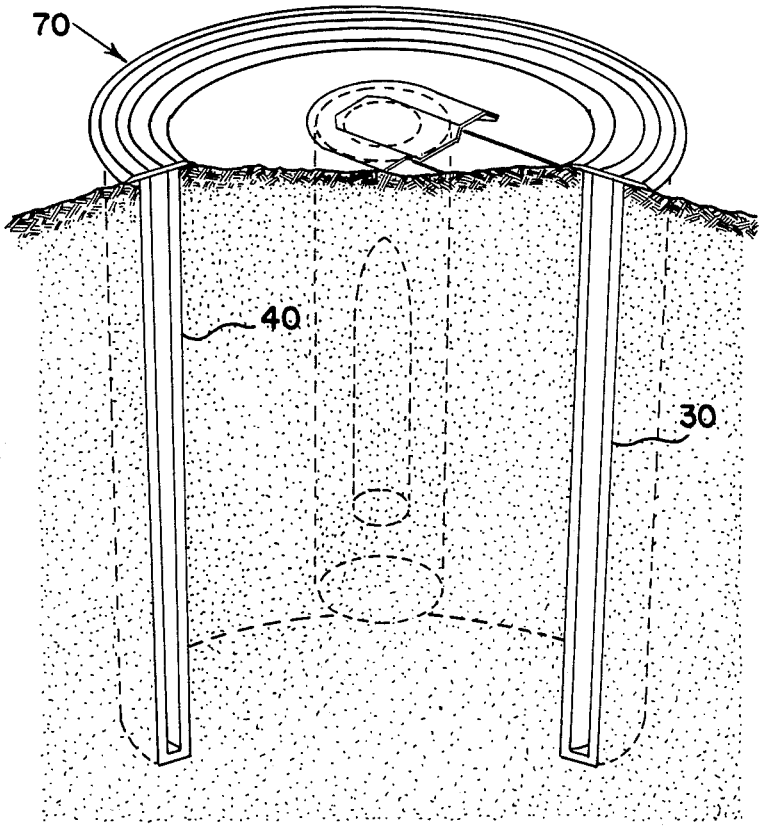
FIG. 9 is a perspective view of an alternative embodiment wherein the slip form annular shapes are descended to the level of the soil grade and capped at the top and sealed at the bottom by a reinforced concrete bearing slab cast at the foot or sole of the annular shapes.
Figure 10:
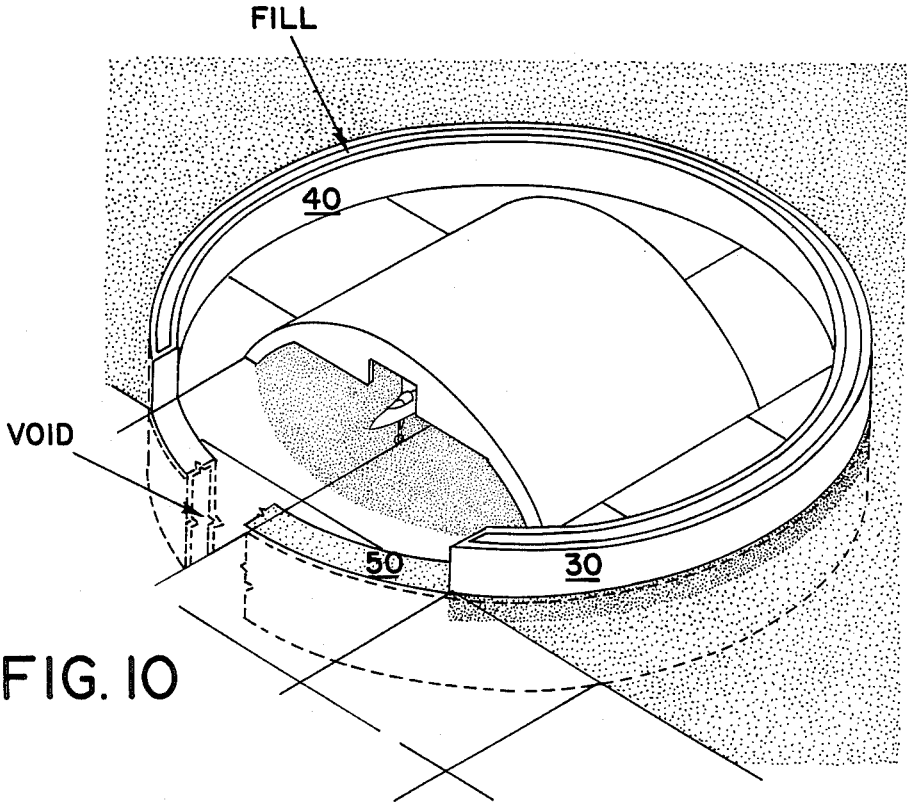
FIG. 10 is an alternative embodiment showing the completed annular shapes extending above ground level with that portion above ground level filled, for example, with a shock absorbing lean mix concrete fill.

Excavation may be discontinued at this point such that each of cylinders 30 and 40 protrude above ground level to protect an installation as is shown in FIG. 10. As can be appreciated from FIG. 10, a sill 50 may be constructed at ground level between inner cylinder 40 and outer cylinder 30 as as to support a lean mix concrete fill above ground level to the tops of each of cylinders 30 and 40. The present inventor has found that no coarse aggregate should be utilized in the lean mix concrete fill. An explosive shock impacting upon solidly joined cylinders will transmit the force through the inner cylinder, fracturing the same, causing shards of concrete to act as shrapnel. Of course, other materials and concrete such as plastic foams and/or lightweight concrete containing expanded polystyrene or glass beads or other shock absorbing fill may be utilized in place of the lean mix concrete fill. In the alternative, shown in FIG. 9, soil removal has continued so that the cylinders 30 and 40 as illustrated in FIG. 8, have descended to ground level. Having fully descended, a reinforced concrete bearing plate may be poured between cylinders 30 and 40 so as to prevent further settling as well as to preclude the intrusion of ground water. Such a bearing slab may be continuously poured or poured in segments utilizing appropriate techniques to prevent the intrusion of ground water. However, in some cases it may be necessary to provide sump pumps if ground water seepage is present. As noted, the concrete bearing slab is reinforced as are each of slip formed cylinders 30 and 40. The upper end of the void between cylinders 30 and 40 can be capped as shown at 70. The manner of capping is not critical so long as each of cylinders 30 and 40 are free to move relative to one another. The present inventor has found that a steel plate anchored to only one of cylinders 30 or 40 and permitting a sliding movement with regard to the other of the cylinders is satisfactory to prevent the intrusion of the elements into the void between cylinders 30 and 40.

The inventor has also found that it is possible to control the rate of degree of settling of each of slip formed cylinders 30 and 40 into the soil by means of the device illustrated in FIG. 11. Element 80 denotes a polyvinyl chloride (PVC) or ordinary copper tube water line pipe of three-quarter inch diameter embedded with outer wall 30' so as to extend to the outer face thereof, as shown at 82. Through such a tube or pipe 80 is pumped a slurry gel of conventional type to stabilize the soil in the vicinity of outlet 82. Alternatively, a lubricant such as water or a slurry gel such as silica gel may be pumped to outlet 82. By providing a number of tubes 80 and outlets 82 distributed around the periphery of outer concrete cylinder 30' or along the inner circumference of inner concrete cylinder 40, the settling rate of each of the slip form concrete cylinders may be individually controlled by the pumping of a desired lubricant or soil stabilizer.

The present invention thus provides a suitable construction and method of manufacture of same which increases the probability of survivability of a facility at a minimum cost and requires the least amount of construction time. By use of the foregoing invention, there now exists a means to increase the survivability of existing underground missile silos, missile silos to be constructed, aircraft hangars or shelters and important or vital structures or equipment above ground, i.e. parked aircraft on ramps or parking pads may be given considerably more protection than now exists. Although the double walled cofferdam of reinforced slip form concrete as shown in FIG. 9 is to be sunk flush with ground level, it is to be understood that it may also be descended below ground level (not shown) or may extend above ground level as illustrated in FIG. 10.

The void created between the inside and outside reinforced slip from concrete walls allows for shock dissipation due to discontinuity of explosive or shock forces in the void between the annular concrete shapes. Structures or objects above ground such as aircraft equipment hangars could be protected by reinforced slip formed walls by basically the same method as suggested above, except that the void between the inner and outer cofferdam walls, above grade only, would be filled with a lean mix sand and low cement content fill or other shock absorbing material which, if penetrated by an explosive charge, would not act as shrapnel as would solid reinforced concrete or steel rivetments. The process can also be accomplished modularly, thereby allowing relative ease in reconstructing bomb or other damage to the sections. The reconstruction can occur by placement of pre-made panels, the exact size of the modular section. Utilization of the slip forming method permits automatic control of the jacks which lift the slip forms and is in some ways preferably to the modular system. However, the preferences expressed herein are not intended to be limiting but are merely illustrative of the invention.

Having fully described the invention, what I claim is:

1. A method of constructing a protective device about a facility which method comprises:

(a) forming two vertically upstanding substantially concentric cylinders of concrete upon the surface of the soil, surrounding a facility to be protected, wherein each of said concrete cylinders is formed with a foot portion and each foot portion is provided with a cutting shoe; and (b) excavating the soil beneath and between said cylinders to permit said cylinders to descend into the soil.

2. The method of claim 1, wherein said forming of said cylinders includes the step of slip forming concrete.

3. The method of claim 1, wherein each of said cutting shoes is formed of metal.

4. The method of claim 3, wherein each of said cutting shoes forces the soil beneath each shoe to a location between said cylinders.

5. The method of claim 1, wherein said forming and said excavating steps are performed simultaneously.

6. The method of claim 1, wherein said forming and said excavating steps are performed sequentially.

7. The method of claim 1, wherein each of said forming and said excavating steps are performed intermittently.

8. The method of claim 1, wherein said excavating is discontinued when the cylinder descends completely into the soil.

9. The method of claim 1, wherein said excavating is discontinued before the cylinder descends completely into the soil.

10. A structure for protecting a facility comprising at least two substantially concentric concrete cylinders having a void between each of said cylinders peripherally enclosing the facility, and at least partially embedded into the soil, each of said cylinders having a foot portion formed at least partially of metal.

11. A protective structure as set forth in claim 10, wherein the facility is a missile silo and the concentric cylinders are substantially concentric with said silo and are embedded in the soil at least to the depth of said silo.

12. A protective structure as set forth in claim 10, wherein the facility is a surface facility and said concentric cylinders extend above the soil to a height equal to the height of said surface facility.

13. A protective structure as set forth in claim 10, wherein each of said concentric cylinders extends both below and above said soil and in the portions of said cylinders extending below the surface of the soil adjacent said cylinders each define a void space and in the portions of said cylinders extending above the surface of the soil, the space between adjacent cylinders is filled with a lean mix concrete.

14. A protective structure as set forth in claim 10, wherein said foot portion comprises a cutting shoe.

15. A protective structure as set forth in claim 14, wherein said cutting shoe is a metal jacket encasing said foot portion.

16. A protective structure as set forth in claim 10, comprising means to regulate the descent of each cylinder in the soil.

17. A protective structure as set forth in claim 16, wherein said means to regulate comprise conduits embedded in said cylinders operably connected to outlets on the surface of each cylinder to provide a friction regulating substance to the surface of each cylinder.

18. A protective structure as set forth in claim 10, wherein each cylinder is undercut from said foot portion.

* * * * *